US008787803B2

(12) United States Patent
Nakasone

(10) Patent No.: US 8,787,803 B2
(45) Date of Patent: Jul. 22, 2014

(54) DEVELOPING DEVICE, IMAGE FORMING UNIT AND IMAGE FORMING APPARATUS

(75) Inventor: Yasushi Nakasone, Tokyo (JP)

(73) Assignee: Oki Data Corporation, Tokyo (JP)

( * ) Notice: Subject to any disclaimer, the term of this patent is extended or adjusted under 35 U.S.C. 154(b) by 298 days.

(21) Appl. No.: 13/284,127

(22) Filed: Oct. 28, 2011

(65) Prior Publication Data

US 2012/0107020 A1 May 3, 2012

(30) Foreign Application Priority Data

Nov. 2, 2010 (JP) ..... 2010-245956

(51) Int. Cl.
*G03G 15/08* (2006.01)

(52) U.S. Cl.
USPC ..... 399/262; 399/258

(58) Field of Classification Search
USPC ..... 399/258, 260, 262, 119
See application file for complete search history.

(56) References Cited

U.S. PATENT DOCUMENTS 5,608,501 A * 3/1997 Makino ..... 399/119
2005/0175373 A1* 8/2005 Okamoto et al. ..... 399/119
2008/0181673 A1* 7/2008 Kim et al. ..... 399/258
2008/0260422 A1* 10/2008 Sasae et al. ..... 399/119

FOREIGN PATENT DOCUMENTS

| | | | |
|---|---|---|---|
| JP | H07-168435 | A | 7/1995 |
| JP | H08-305148 | A | 11/1996 |
| JP | 2007-293035 | A | 11/2007 |
| JP | 2007-293268 | A | 11/2007 |
| JP | 2008-020605 | A | 1/2008 |
| JP | 2008-083549 | A | 4/2008 |
| JP | 2008-233862 | A | 10/2008 |

* cited by examiner

*Primary Examiner* — Walter L Lindsay, Jr.
*Assistant Examiner* — Milton Gonzalez
(74) *Attorney, Agent, or Firm* — Panitch Schwarze Belisario & Nadel LLP

(57) ABSTRACT

A developing device includes a developing device main body and a developer cartridge detachably mounted to the developing device main body and storing a developer. The developer cartridge includes a case member that stores a developer, a supplying opening provided on the case member, and a first shutter that opens and closes the supplying opening. The developing device main body includes a housing that stores the developer supplied by the developer cartridge, a receiving opening provided on the housing, and a second shutter that opens and closes the receiving opening. The first shutter and the second shutter are configured to move in conjunction with each other.

13 Claims, 11 Drawing Sheets

DEVELOPING DEVICE, IMAGE FORMING UNIT AND IMAGE FORMING APPARATUS

BACKGROUND OF THE INVENTION

The present invention relates to a developing device having a detachable developer cartridge, an image forming unit (i.e., a process cartridge) and an image forming apparatus.

An image forming apparatus using electrophotography is generally configured to form a latent image on a surface of a photosensitive drum, develop the latent image using a developing device to form a toner image, and transfer the toner image to a recording medium. The developing device has a main body, and a detachable toner cartridge storing a toner (i.e., a developer). The main body has a toner receiving opening (i.e., a developer receiving opening) for receiving the toner supplied by the toner cartridge. Such a developing device is disclosed in, for example, Japanese Laid-open Patent Publication No. 2008-20605 (see, paragraphs 0018 and 0022).

In a general developing device, when the toner cartridge is detached from the main body of the developing device for replacement, the toner receiving opening is left open, and therefore foreign matters may enter the toner receiving opening.

SUMMARY OF THE INVENTION

In an aspect of the present invention, it is intended to provide a developing device, an image forming unit and an image forming apparatus capable of preventing foreign materials from entering a developer receiving opening.

According to an aspect of the present invention, there is provided a developing device including a developing device main body, and a developer cartridge detachably mounted to the developing device main body and storing a developer. The developer cartridge includes a case member that stores a developer, a supplying opening provided on the case member, and a first shutter that opens and closes the supplying opening. The developing device main body includes a housing that stores the developer supplied by the developer cartridge, a receiving opening provided on the housing, and a second shutter that opens and closes the receiving opening. The first shutter and the second shutter are configured to move in conjunction with each other.

Since the receiving opening can be closed by the second shutter, foreign matters are prevented from entering the receiving opening even in a state where the developer cartridge is detached from the developing device main body.

According to another aspect of the present invention, there is provided an image forming unit including the above described developing device.

According to still another aspect of the present invention, there is provided an image forming apparatus including the above described image forming unit.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings.

First Embodiment

Figure 1:
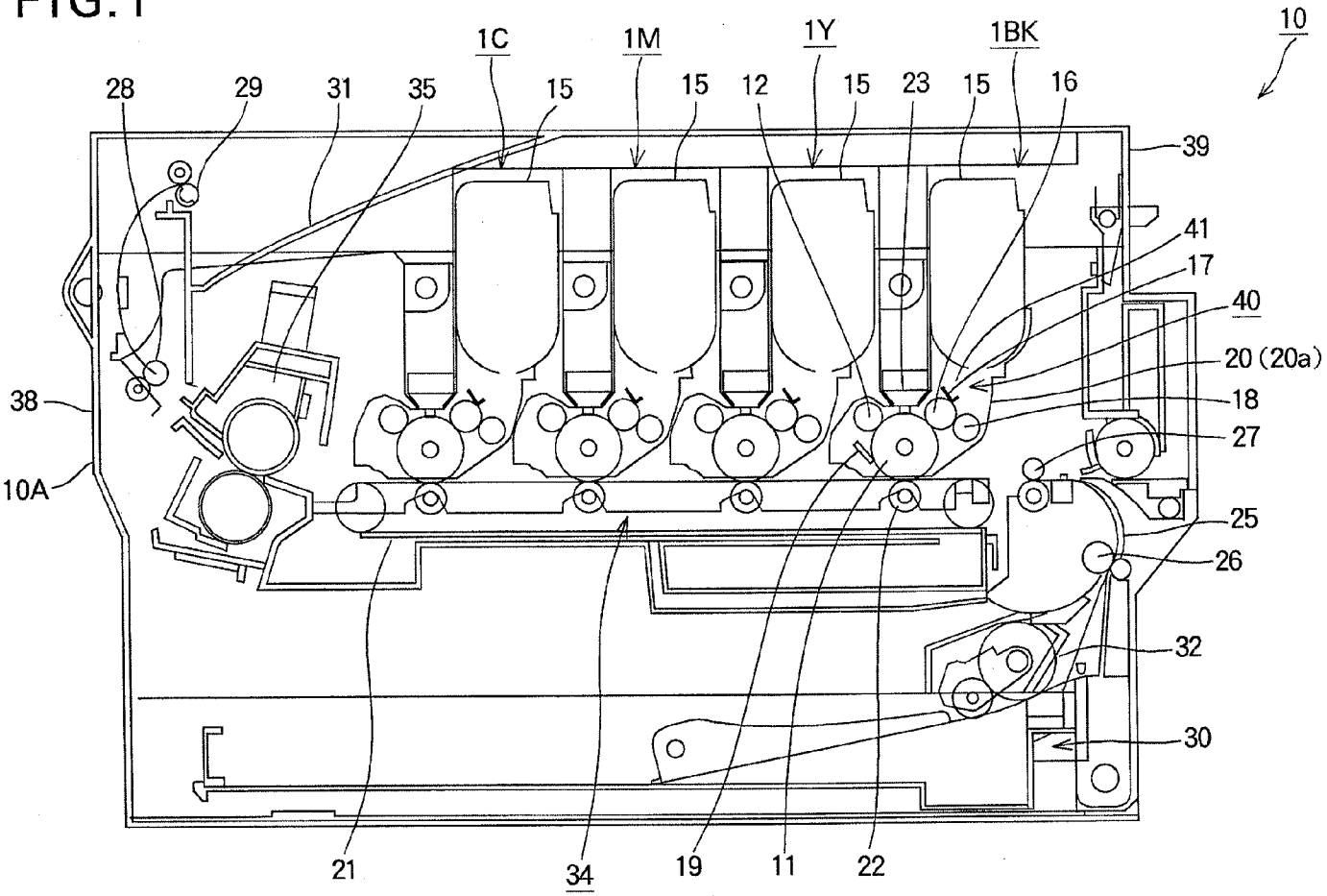
FIG. 1 is a schematic side view showing an entire configuration of a printer as an image forming apparatus according to the first embodiment of the present invention.

FIG. 1 is a schematic sectional side showing a printer 10 as an image forming apparatus according to the first embodiment of the present invention. The printer 10 has a lower frame 38 and an upper frame 39 that constitute a housing 10A. A conveying path 25 is provided in the housing 10A, along which a medium (i.e., a sheet) is conveyed.

The printer 10 includes process cartridges 1Bk, 1Y, 1M and 1C as image forming units which are arranged in tandem along the conveying path 25 (i.e., from right to left in FIG. 1). The process cartridges 1Bk, 1Y, 1M and 1C are respectively configured to form toner images (i.e., developer images) of black, yellow, magenta and cyan. The process cartridges 1Bk, 1Y, 1M and 1C are detachably mounted to the lower frame 38. LED (Light Emitting Diode) heads 23 as exposure devices are mounted to the upper frame 39 so as to face respective photosensitive drums 11 (described later) of the process cartridges 1Bk, 1Y, 1M and 1C.

A transfer unit 34 is provided below the process cartridges 1Bk, 1Y, 1M and 1C. The transfer unit 34 is configured to convey the medium, and to transfer the toner images of respective colors to the medium. The above described conveying path 25 is provided so as to pass through the process cartridges 1Bk, 1Y, 1M and 1C and the transfer unit 34.

The transfer unit 34 includes a movable transfer belt 21, and transfer rollers 22 as transfer members provided so as to face the respective photosensitive drums 11. The transfer belt 21 and the transfer rollers 22 are applied with predetermined bias voltages by a voltage applying unit (not shown), so as to transfer the toner images from the photosensitive drums 11 to the medium.

A fixing unit 35 is provided on a downstream side of the transfer unit 34 in a conveying direction of the medium. The fixing unit 35 is configured to fix the toner image (transferred by the process cartridges 1Bk, 1Y, 1M and 1C and the transfer unit 34) to the medium.

A feeding cassette 30 is provided below the transfer unit 34. The feeding cassette 30 is located at an end of the conveying path 25, and is configured to store a stack of media (i.e., sheets). A feeding portion 32 is provided on the feeding cassette 30. The feeding portion 32 is configured to feed the medium one by one into the conveying path 25. Two conveying roller pairs 26 and 27 are provided along the conveying path 25. The conveying roller pairs 26 and 27 are configured to convey the medium (fed by the feeding portion 32) toward the process cartridges 1Bk, 1Y, 1M and 1C and the transfer unit 34.

Two ejection roller pairs 28 and 29 are provided on the downstream side of the fixing unit 35 in the conveying direction of the medium. The ejection roller pairs 28 and 29 are configured to eject the medium outside the housing 10A of the printer 10. A stacker portion 31 is provided on the upper part of the upper frame 39 for placing the ejected medium.

Next, the process cartridges 1Bk, 1Y, 1M and 1C will be described. The process cartridges 1Bk, 1Y, 1M and 1C have the same configurations except the toners, and are therefore collectively referred to as the process cartridge 1.

The process cartridge 1 includes the photosensitive drum 11 as a latent image bearing body. The photosensitive drum 11 is a cylindrical member having a photosensitive layer on a circumferential surface. The photosensitive layer is capable of holding electric charge. The photosensitive drum 11 is driven by a drum motor (as a driving portion) to rotate at a predetermined rotational speed.

The process cartridge 1 includes a charging roller 12 as a charging device that uniformly charges the surface of the photosensitive drum 11. The charging roller 12 is pressed against the photosensitive drum 11 at a constant pressure, and rotates together with the rotation of the photosensitive drum 11. The charging roller 12 is applied with a predetermined bias voltage by a voltage applying unit (not shown), and uniformly charges the surface of the photosensitive drum 11.

The surface (i.e., the photosensitive layer) of the photosensitive drum 11 uniformly charged by the charging roller 12 is exposed with light emitted by the LED head 23. An electric potential of an exposed part of the surface of the photosensitive drum 11 varies, and a latent image is formed in accordance with an exposure pattern.

The process cartridge 1 includes a developing device 40 provided adjacent to the photosensitive drum 11. The developing device 40 is configured to develop the latent image on the surface of the photosensitive drum 11. The developing device 40 includes a developing roller 16 as a developer bearing body that causes a toner (i.e., a developer) to adhere to the surface of the photosensitive drum 11, a developing blade 17 as a developer regulating member that regulates a thickness of a layer of the toner on the developing roller 16, and a toner supplying roller 18 as a developer supplying member that supplies the toner to the developing roller 16.

The developing roller 16 is formed of a metal shaft having electrical conductivity covered with a semiconductive rubber layer. The developing roller 16 is pressed against the photosensitive drum 11 at a constant pressure, and rotates in a direction opposite to a rotational direction of the photosensitive drum 11 so as to cause the toner to adhere to the surface of the photosensitive drum 11. The developing roller 16 is applied with a predetermined bias voltage by a voltage applying unit (not shown).

The toner supplying roller 18 is formed of a metal shaft having electrical conductivity covered with a rubber layer. The toner supplying roller 18 is pressed against the developing roller 16 at a constant pressure, and rotates in the same direction as the developing roller 16 so as to supply the toner to the developing roller 16. A toner hopper 41 is provided above the developing roller 16 and the toner supplying roller 18. The toner hopper 41 is provided for holding the toner supplied from the toner cartridge 15.

The developing device 40 has a toner cartridge 15 as a developer cartridge (i.e., a developer storage body) for storing the toner. A configuration of the toner cartridge 15 will be described later.

A part of the developing device 40 except the detachable toner cartridge 15 is referred to as a developing unit main body 20. More specifically, the developing unit main body 20 is a portion including the developing roller 16, the developing blade 17, the toner supplying roller 18 and the toner hopper 41. The developing device main body 20 has a housing 20*a*. The housing 20*a* also functions as a housing of the process cartridge 1. The above described toner cartridge 1 is detachably mounted to an upper part of the housing 20*a*.

The process cartridge 1 includes a cleaning blade 19 as a cleaning member. The cleaning blade 19 has an elongated shape extending along an axial direction of the photosensitive drum 11, and is provided so as to contact the photosensitive drum 11. As the photosensitive drum 11 rotates, the cleaning blade 19 scrapes off the toner from the surface of the photosensitive drum 11.

The developing device main body 20 and the toner cartridge 15 constitute the developing device 40 as described above. The developing device main body 20 is also referred to as a developing unit. Further, a part of the process cartridge 1 (i.e., the image forming unit) except the toner cartridge 15 is referred to as an image forming unit main body. More specifically, the image forming unit main body includes the developing device 40, the photosensitive drum 11, the charging roller 12 and the cleaning blade 19.

The toner cartridge 15 and the developing device main body 20 (constituting the process cartridge 1) will be described.

Figure 2:
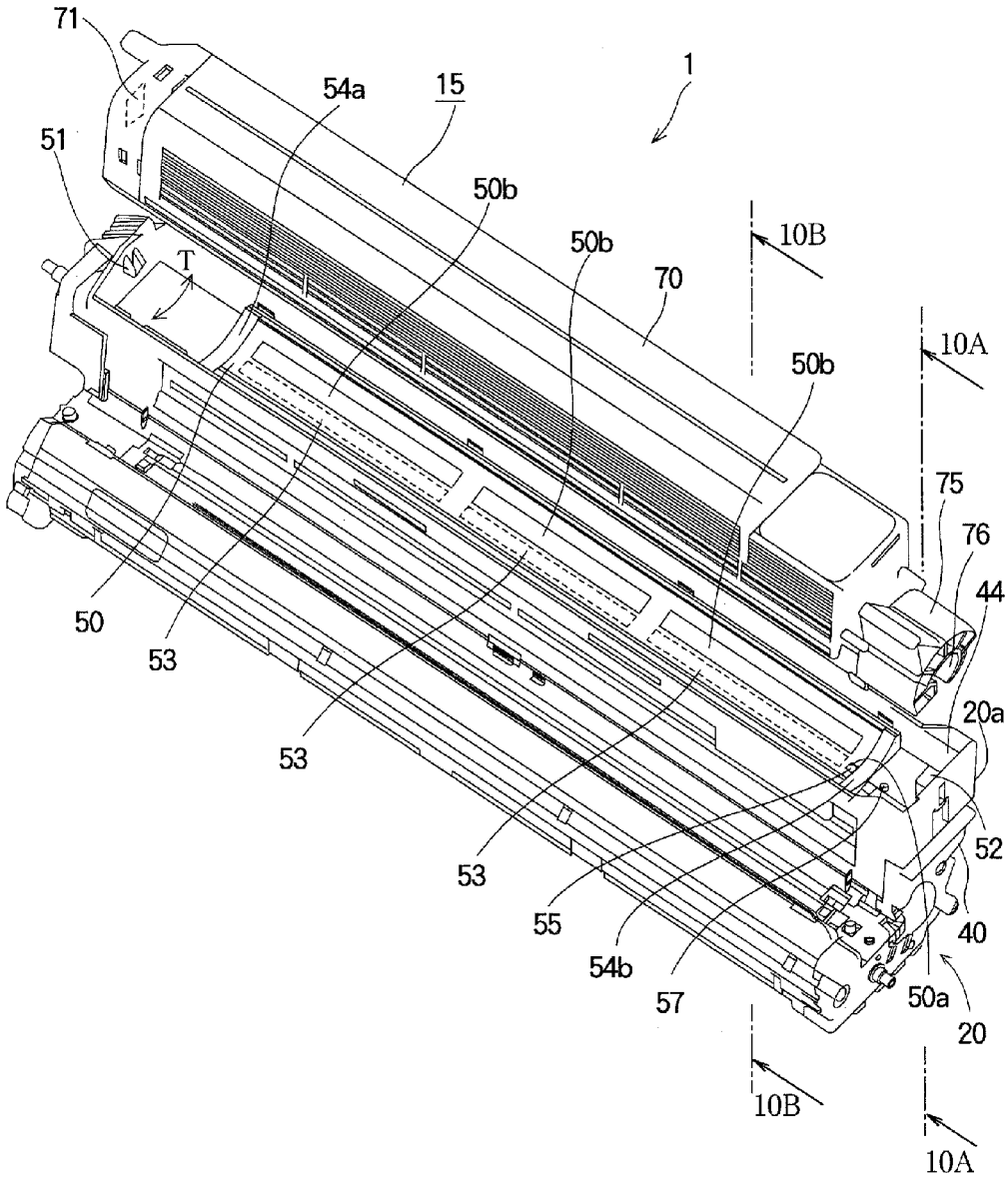
FIG. 2 is a perspective view showing a process cartridge according to the first embodiment of the present invention in a state where a toner cartridge is detached from a unit main body.
Figure 3:
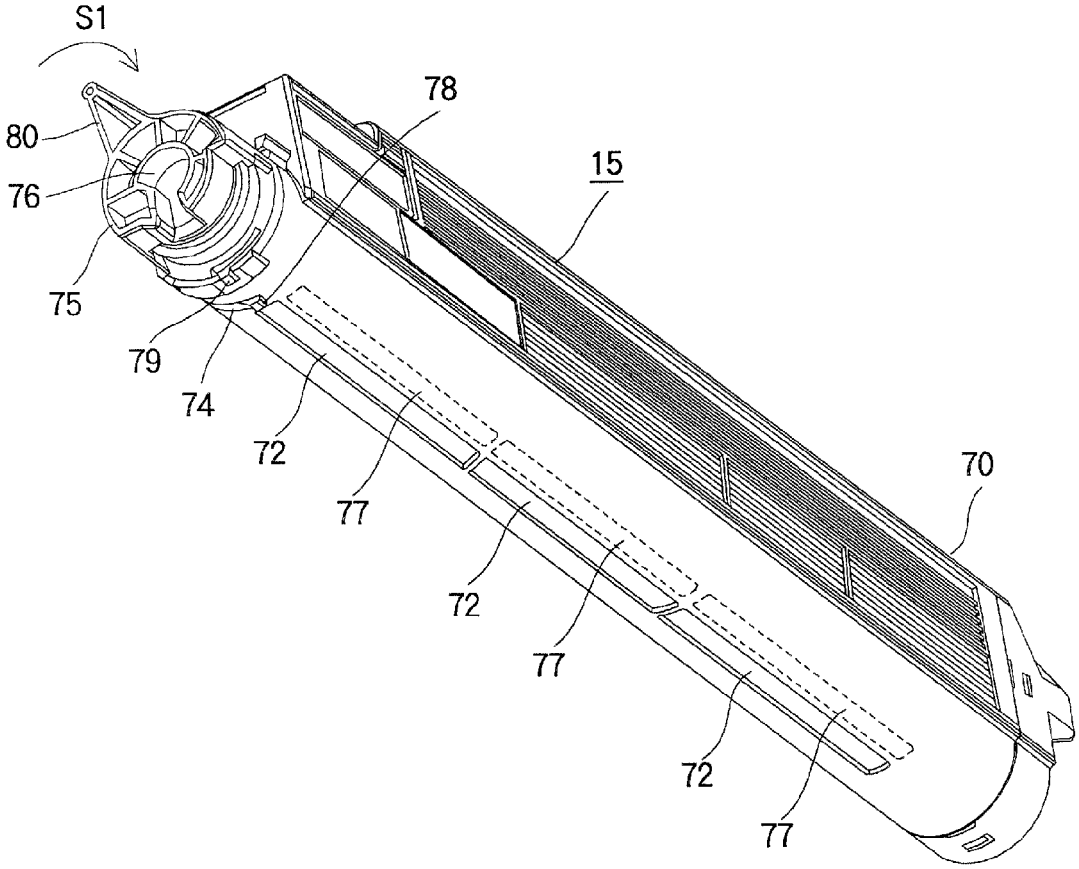
FIG. 3 is a perspective view showing the toner cartridge according to the first embodiment of the present invention.
Figure 4:
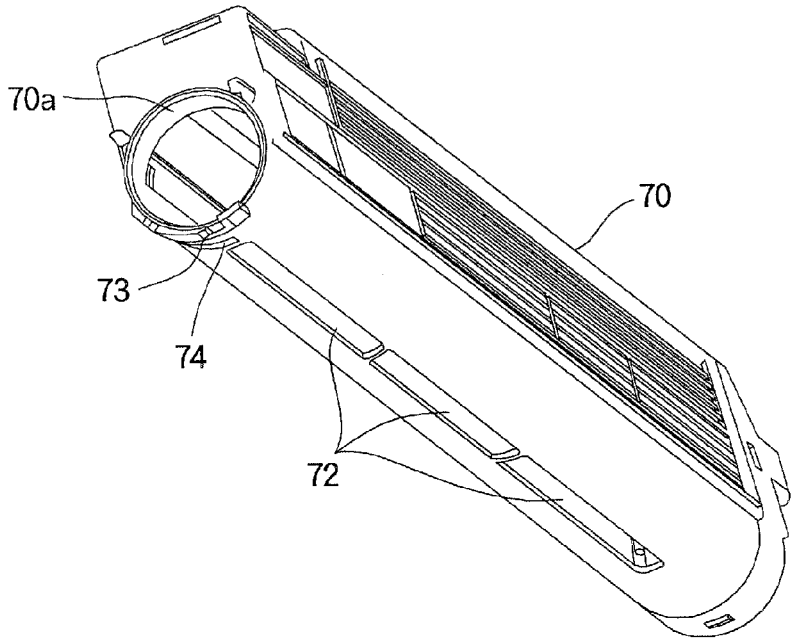
FIG. 4 is a perspective view showing a cover cartridge of the toner cartridge according to the first embodiment of the present invention.
Figure 5:
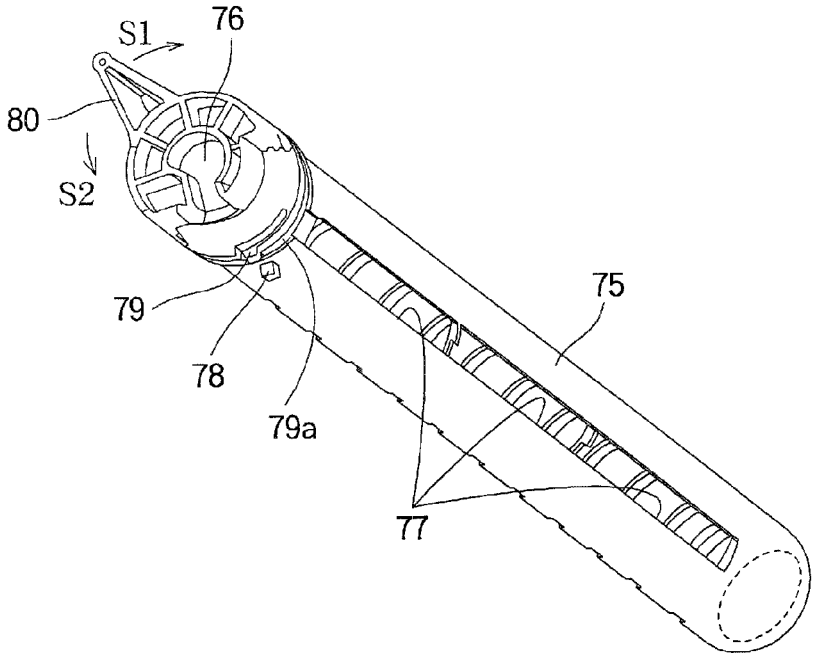
FIG. 5 is a perspective view showing a first shutter of the toner cartridge according to the first embodiment of the present invention.

FIG. 2 is a perspective view showing the process cartridge 1 in a state where the toner cartridge 15 is detached from the developing device main body 20. FIG. 3 is a perspective view showing the toner cartridge 15. FIG. 4 is a perspective view showing a cover cartridge 70 of the toner cartridge 15. FIG. 5 is a perspective view showing a first shutter 75 of the toner cartridge 15.

As shown in FIG. 2, the toner cartridge 15 has an elongated shape elongated in one direction. The toner cartridge 15 is mounted to a cartridge mounting portion 44 formed on the upper part of the developing device main body 20. The cartridge mounting portion 44 is in the form of a recess elongated in a direction parallel to the axial direction of the photosensitive drum 11.

The toner cartridge 15 will be described. As shown in FIG. 3, the toner cartridge 15 includes a cover cartridge 70 as a case member storing the toner therein, and a first shutter 75 rotatably provided in the cover cartridge 70. The cover cartridge 70 has an upper case portion having a substantially parallelepiped shape and a lower case portion having a substantially semicylindrical shape. A supplying opening 72 is formed on the lower case portion of the cover cartridge 70. The toner is ejected from the toner cartridge 15 via the supplying opening 72.

As shown in FIG. 4, an opening 70*a* of a circular shape is formed on an end of the cover cartridge 70 in a longitudinal direction. Further, a recess portion 71 (FIG. 2) is formed on the other end of the cover cartridge 70 in the longitudinal direction. The recess portion 71 engages a first protrusion 51 (FIG. 2) of the developing device main body 20 when the toner cartridge 15 is mounted to the developing device main body 20.

As shown in FIG. 5, the first shutter 75 has a substantially cylindrical shape. The first shutter 75 rotates about a rotation axis (i.e., a center axis of the cylindrical shape) in such a manner that the first shutter slides along an inner circumferential surface of the lower case portion of the cover cartridge 70 and a sliding portion (not shown). Rotational directions of the first shutter 75 are shown by arrows S1 and S2, which will be described later. The first shutter 75 has a first opening 77 corresponding to the supplying opening 72 of the cover cartridge 70.

An end of the first shutter 75 (in the longitudinal direction) protrudes outside from the cover cartridge 70 via the opening 70*a*. A lever portion 80 as an operating portion is formed at a protruding portion of the first shutter 75. The lever portion 80 is gripped by a user when the user rotates the first shutter 75.

Figure 6:
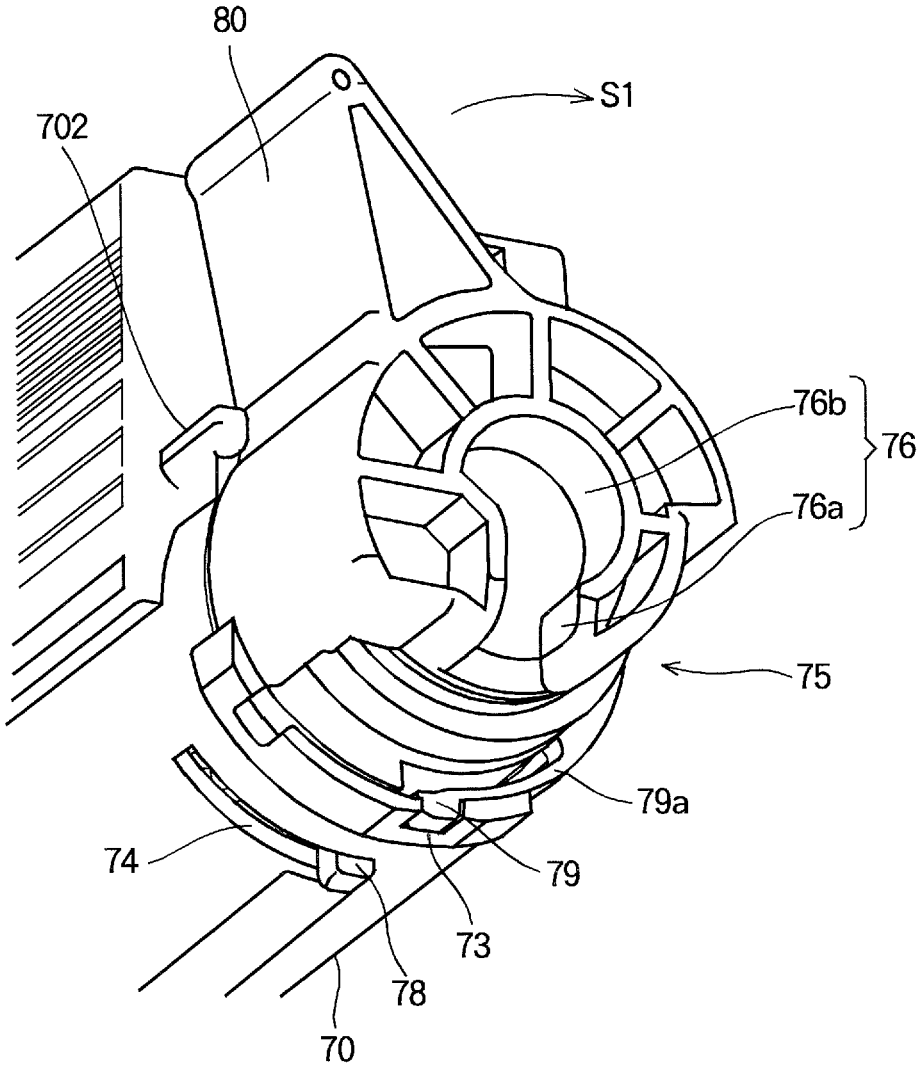
FIG. 6 is an enlarged perspective view showing a part of the first shutter of the toner cartridge according to the first embodiment of the present invention.

FIG. 6 is an enlarged perspective view showing the vicinity of an end portion of the toner cartridge 15 (on the lever portion 80 side) in the longitudinal direction. A lock portion 76 is formed on the end of the first shutter 75 on the lever portion 80 side. When the toner cartridge 15 is mounted to the developing unit main body 20, the lock portion 76 engages a second protrusion 52 (FIG. 2) formed on the housing 20*a* of the developing device main body 20. The lock portion 76 includes, for example, a groove portion 76*a* extending in a radial direction and a center hole 76*b* connected to the groove portion 76*a*. When the toner cartridge 15 is mounted to the developing unit main body 20, the second protrusion 52 (FIG. 2) passes through the groove portion 76*a* and reaches the center hole 76*b*. In this state, when the first shutter 75 is rotated in a direction shown by an arrow S1, the groove portion 76*a* is displaced, and the protrusion 52 is held in the center hole 76*b*. Therefore, the toner cartridge 15 is fixed to the developing device main body 20.

As shown in FIG. 6, a cantilever portion 79*a* is formed at a part (i.e., a lower part in FIG. 6) of the first shutter 75 (in the vicinity of the longitudinal end of the first shutter 75) facing the developing device main body 20. The cantilever portion 79*a* extends in a circumferential direction of the first shutter 75 (i.e., a rotational direction of the first shutter 75). A hook portion 79 as a first lock member is formed at an end of the cantilever portion 79*a*. The hook portion 79 engages an engaging portion 73 as an engaging opening formed on the cover cartridge 70, so as to lock the rotation of the first shutter 75. The engaging portion 73 is in the form of a recess formed on a periphery of the opening 70*a* (see, FIG. 4). When the hook 79 is pressed inwardly in a radial direction of the first shutter 75, the cantilever portion 79*a* is deformed, and the hook 79 moves out of the engaging portion 73. In this state, the lock on the first shutter 75 is released, and the first shutter 75 becomes rotatable.

As shown in FIG. 5, the first shutter 75 has a first engaging portion (i.e., a shutter hook) 78 protruding from a circumferential surface of the first shutter 75. The first engaging portion 78 is located closer to a longitudinal center of the first shutter 75 side than the hook portion 79 is. Further, the first engaging portion is located ahead of the first opening 77 in the direction shown by the arrow S1.

As shown in FIG. 6, the cover cartridge 70 has a rail portion 74 in the form of a groove which the first engaging portion 78 of the first shutter 75 engages. The rail portion 74 extends in a circumferential direction of the first shutter 75, i.e., the rotational direction of the first shutter 75. When the first shutter 75 is rotated in the direction shown by the arrow S1, the first engaging portion 78 moves along the rail portion 74.

When the first shutter 75 is rotated in the direction shown by the arrow S1 so that the first opening 77 of the first shutter 75 (FIG. 5) overlaps with the supplying opening 72 (FIG. 4) of the cover cartridge 70, the supplying opening 72 is opened, and the toner in the toner cartridge 15 is supplied to the outside.

In this regard, the first engaging portion 78 of the first shutter 75 engages a second engaging portion 50*a* of a second shutter 50 (FIG. 7 described later) so that the first shutter 75 and the second shutter 50 move in conjunction with each other (i.e., move together with each other). A description of the second shutter 50 will be made later.

Further, the cover cartridge 70 has a rotation stopper 701 (FIG. 8) and another rotation stopper 702 (FIGS. 6 and 8). The rotation stopper 701 abuts against the first shutter 75 when the first shutter 75 rotates in the direction shown by the arrow S1. The rotation stopper 702 abuts against the first shutter 75 when the first shutter 75 rotates in the direction shown by the arrow S2. The rotation stoppers 701 and 702 are both in the form of protrusions.

Next, the developing device main body 20 will be described.

As shown in FIG. 2, the developing device main body 20 has the second protrusion 52 on an end of the cartridge mounting portion 44 in the longitudinal direction. The second protrusion 52 engages the above described lock portion 76. The developing device main body 20 further has the first protrusion 51 on the other end of the cartridge mounting portion 44 in the longitudinal direction. The first protrusion 51 engages the recess portion 71 of the toner cartridge 15. By the engagement between the recess portion 71 and the first protrusion 51 and the engagement between the lock portion 76 and the second protrusion 52, the toner cartridge 15 is fixed to the developing device main body 20.

The developing device main body 20 has a receiving opening 53 for receiving the toner supplied by the toner cartridge 15, and a second shutter 50 for opening and closing the receiving opening 53. The second shutter 50 is in the form of a thin plate having a larger area than the supplying opening 72 of the cover cartridge 70, and elongated in the longitudinal direction of the cover cartridge 70. The second shutter 50 has a second opening 50*b* corresponding to the supplying opening 72 of the cover cartridge 70.

Figure 7:
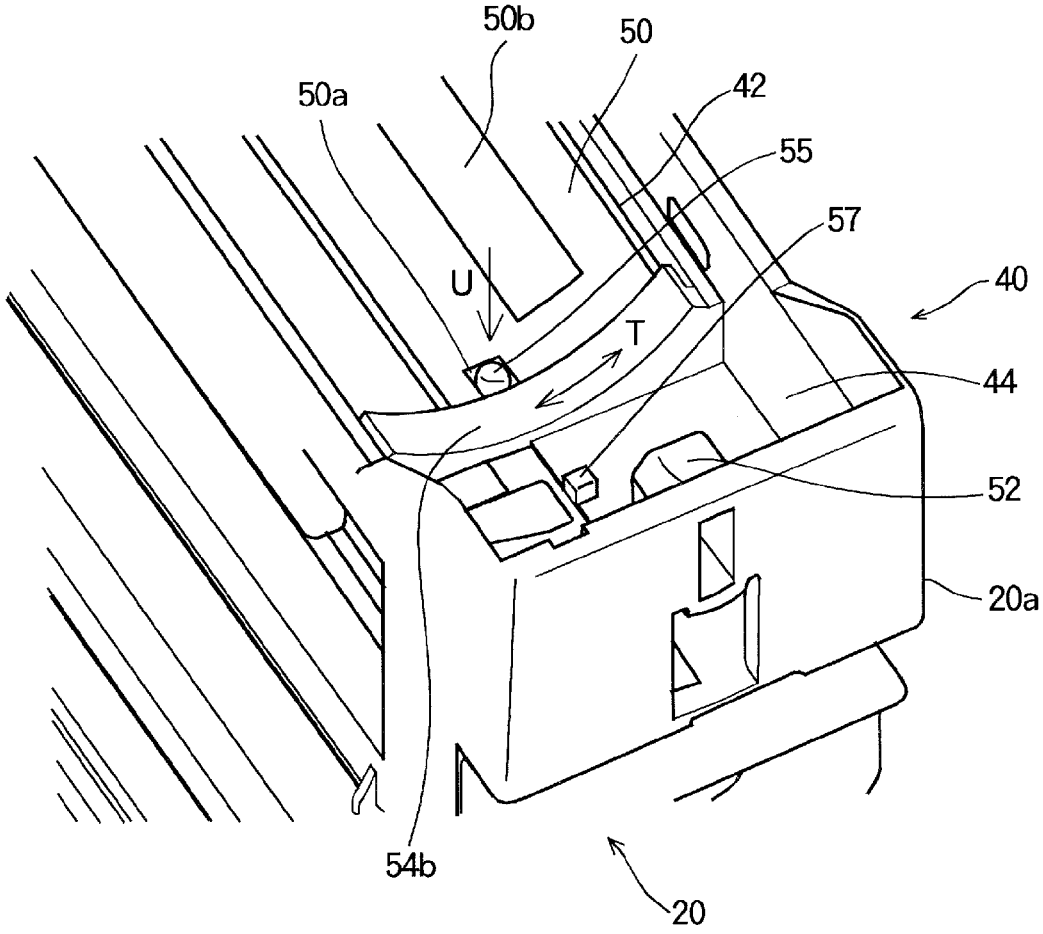
FIG. 7 is an enlarged perspective view showing a part of the unit main body according to the first embodiment of the present invention.

FIG. 7 is an enlarged perspective view showing the vicinity of an end (on the second protrusion 52 side) of the cartridge mounting portion 44 in the longitudinal direction. The cartridge mounting portion 44 has a sliding surface 42 (see FIG. 10A) having a cylindrical shape along the outer circumferential surface of the cover cartridge 70. The second shutter 50 is slidable along the sliding surface 42 as shown by an arrow T in FIG. 7. The second shutter 50 is guided by guide portions 54*a* and 54*b* (the guide portion 54*a* is shown in FIG. 2) at both ends in the longitudinal direction. The above described receiving opening 53 (FIG. 2) is formed on the sliding surface 42 of the developing device main body 20.

The second engaging portion 50*a* (i.e., an engaging opening) is provided in the vicinity of an end of the second shutter 50 in the longitudinal direction. The second engaging portion 50*a* is in the form of, for example, a rectangular hole. The second engaging portion 50*a* engages the first engaging portion 78 of the first shutter 75 as described later, so that the first shutter 75 and the second shutter 50 move in conjunction with each other.

A shutter lock 55 as a second lock member is provided inside the second engaging portion 50*a*. The shutter lock 55 is pressed by a biasing spring 56 (see FIG. 9A) in a direction in which the shutter lock 55 is fitted into the second engaging portion 50*a*. The biasing spring 56 is provided in the housing 20*a* of the developing device main body 20. The sliding movement of the second shutter 50 is locked by the engagement between the shutter lock 55 and the second engaging portion 50*a*. In contrast, when the shutter lock 55 moves out of the second engaging portion 50*a* by being pressed as shown by an arrow U in FIG. 7 resisting the force of the biasing spring 56, the engagement between the shutter lock 55 and the second engaging portion 50*a* is released, and the second shutter 50 becomes slidable (movable).

A lock-release portion 57 is provided on the cartridge mounting portion 44 of the developing device main body 20. The lock-release portion 57 is in the form of a protrusion. When the toner cartridge 15 is mounted to the cartridge mounting portion 44, the lock-release portion 57 presses the hook portion 79 (i.e., the first lock member) of the first shutter 75 of the toner cartridge 15 so as to move the hook portion 79 out of the engaging portion 73, i.e., to allow the rotation of the first shutter 75.

Next, an operation of the printer 10 according to the first embodiment will be described with reference to FIG. 1.

When a power of the printer 10 is turned on, a control unit (not shown) of the printer 10 performs an initial operation so as to place the printer 10 in a standby mode. When the printer 10 receives a print command from a host computer (i.e., a host device), the control unit drives the feeding portion 32 to feed the medium one by one from the feeding cassette 30 into the conveying path 25. Then, the medium is conveyed by the conveying roller pairs 26 and 27 to the transfer belt 21, and is held by the transfer belt 21 by absorption. By the movement of the transfer belt 21, the medium is conveyed through between the transfer unit 34 and the process cartridges 1Bk, 1Y, 1M and 1C.

In the process cartridges 1Bk, 1Y, 1M and 1C, the charging rollers 12 uniformly charge the surfaces of the photosensitive drums 11, and the LED heads 23 expose the surfaces of the photosensitive drums 11 to form latent images thereon. Then, the developing devices 40 develop the latent images to form toner images of the respective colors.

While the medium is conveyed by the transfer belt 21 along the process cartridges 1Bk, 1Y, 1M and 1C, the toner images of the respective colors are transferred from the photosensitive drums 11 to the medium, so that a color toner image is transferred to the medium. The medium is then conveyed to the fixing unit 35, where the color toner image is fixed to the medium. Then, the medium is ejected out of the printer 10 by the ejection roller pairs 28 and 29, and is placed on the stacker portion 31.

In each process cartridge, the toner remaining on the photosensitive drum 11 is scraped off and removed by the cleaning blade 19. The scraped-off toner is referred to as a waste toner (i.e., a waste developer). The waste toner is collected in a waste toner chamber (not shown) provided in the toner cartridge 15.

As the image formation operation is repeated, the toner stored in the toner cartridge 15 is gradually consumed. When the toner in the toner cartridge 15 is used up, it is necessary to replace the toner cartridge 15. A description will be made of opening and closing operations of the supplying opening 72 of the toner cartridge 15 and the receiving opening 53 of the developing device main body 20 when the toner cartridge 15 is mounted to or detached from the developing device main body 20.

Figure 8A:
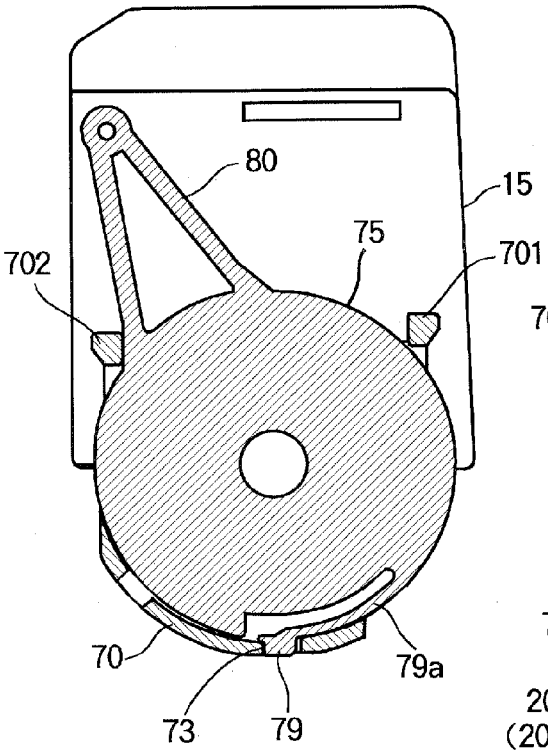
FIGS. 8A and 8B are sectional views respectively showing a lock operation and a lock-release operation of the first shutter according to the first embodiment of the present invention.
Figure 8B:
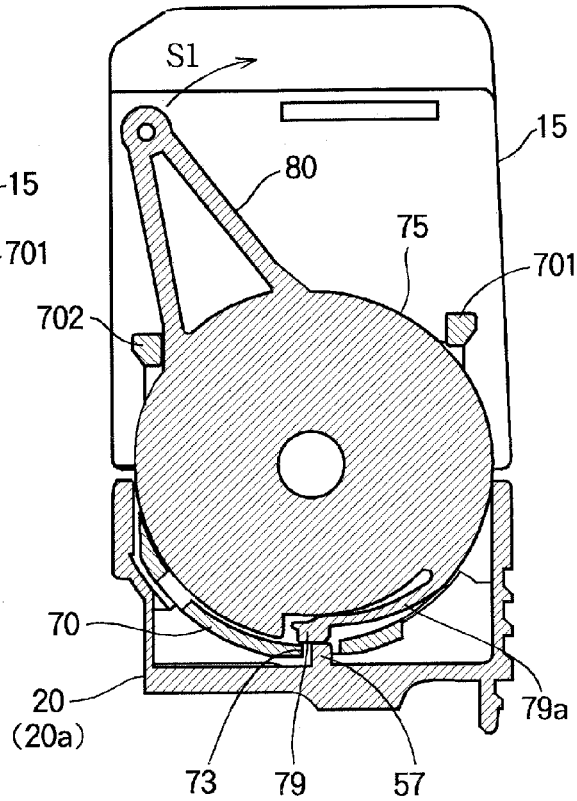
Figure 9A:
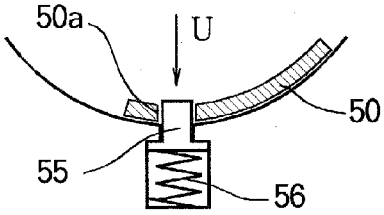
FIGS. 9A and 9B are sectional views respectively showing a lock operation and a lock-release operation of a second shutter according to the first embodiment of the present invention.
Figure 9B:
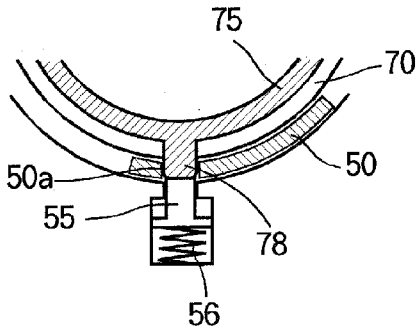

FIG. 8A is a schematic view showing a lock operation on the first shutter 75 in a state where the toner cartridge 15 is not yet mounted to the developing device main body 20. FIG. 8B is a schematic view showing a lock-release operation of the lock on the first shutter 75 in a state where the toner cartridge 15 is mounted to the developing device main body 20. FIG. 9A is a schematic view showing a lock operation on the second shutter 50 in a state where the toner cartridge 15 is not yet mounted to developing device main body 20. FIG. 9B is a schematic view showing a lock-release operation of the lock on the second shutter 50 in a state where the toner cartridge 15 is mounted to the developing device main body 20.

As shown in FIG. 8A, in a state where the toner cartridge 15 is not mounted to the developing device main body 20, the hook portion 79 of the first shutter 75 of the toner cartridge 15 engages the engaging portion 73 of the cover cartridge 70 so as to lock the rotation of the first shutter 75. In this state, the first opening 77 of the first shutter 75 and the supplying opening 72 of the cover cartridge 70 are displaced with respect to each other in the direction shown by the arrow S1 (see, FIG. 10B described later). That is, the supplying opening 72 of the toner cartridge 15 is closed.

Further, as shown in FIG. 9A, the shutter lock 55 of the developing device main body 20 engages the second engaging portion 50*a* (the engaging opening) of the second shutter 50, and therefore the rotation of the second shutter 50 is locked. In this state, the second opening 50*b* of the second shutter 50 and the receiving opening 53 of the developing device main body 20 are displaced with respect to each other in the direction shown by the arrow S1 (see, FIG. 10B described later). That is, the receiving opening 53 is closed.

Here, the toner cartridge 15 is mounted to the developing device main body 20. More specifically, the recess portion 71 (FIG. 2) of the toner cartridge 15 engages the first protruding portion 51 of the developing device main body 20, and then the lock portion 76 (FIG. 2) of the toner cartridge 15 engages the second protrusion 52 of the developing device main body 20. As shown in FIG. 8B, the hook portion 79 of the first shutter 75 is pressed by the lock-release portion 57 of the developing device main body 20, and the cantilever portion 79*a* is resiliently deformed, with the result that the hook portion 79 moves out of the engaging portion 73. That is, the lock on the first shutter 75 is released, and the first shutter 75 becomes rotatable in the direction shown by the arrow S1.

Further, as shown in FIG. 9B, the first engaging portion 78 of the first shutter 75 presses the shutter lock 55, and the shutter lock 55 moves out of the second engaging portion 50*a* of the second shutter 50. That is, the lock on the second shutter 50 is released. At the same time, the first engaging portion 78 engages the second engaging portion 50*a* of the second shutter 50, so that the first shutter 75 and the second shutter 50 become movable (rotatable) in conjunction with each other.

After the toner cartridge 15 is mounted to the developing device main body 20 as described above, the user rotates the first shutter 75 of the toner cartridge in the direction shown by the arrow S1. Since the first shutter 75 can be rotated by operating the lever portion 80 located at a large distance from the rotation axis, the user can rotate the first shutter 75 with a light force.

Figure 10A:
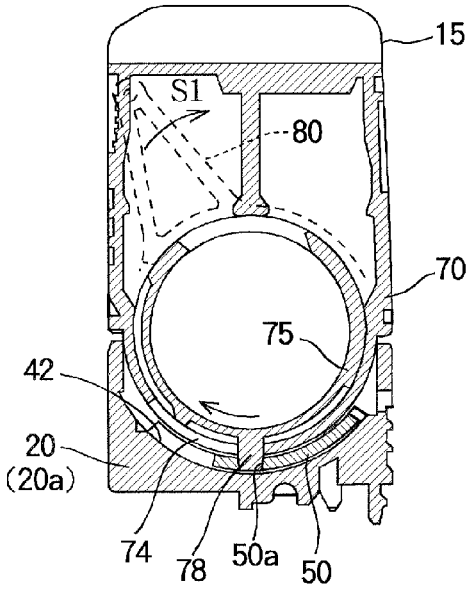
FIGS. 10A and 10B are sectional views showing functions of the first shutter and the second shutter according to the first embodiment of the present invention.
Figure 10B:
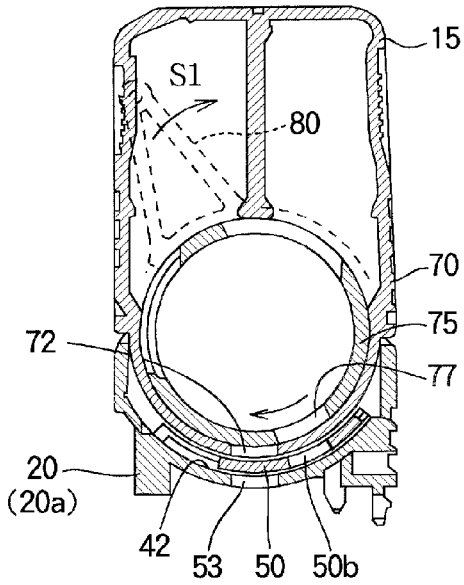
Figure 11A:
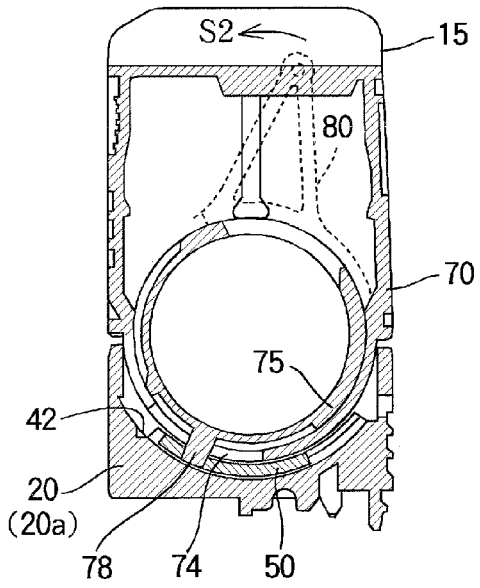
FIGS. 11A and 11B are sectional views showing functions of the first shutter and the second shutter according to the first embodiment of the present invention.
Figure 11B:
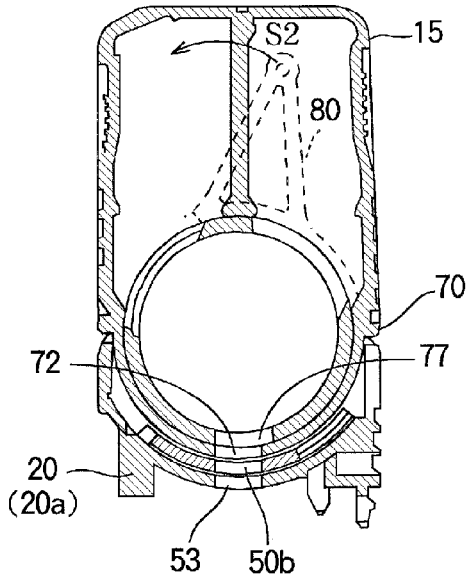

FIGS. 10A and 10B are sectional views showing the toner cartridge 15 and the developing device main body 20 before the first shutter 75 is rotated. FIG. 10A corresponds to a cross section taken along line 10A-10A in FIG. 2. FIG. 10B corresponds to a cross section taken along line 10B-10B in FIG. 2. FIGS. 11A and 11B are sectional views showing the toner cartridge 15 and the developing device main body 20 after the first shutter 75 is rotated. FIG. 11A corresponds to a cross section taken along line 10A-10A in FIG. 2. FIG. 11B corresponds to a cross section taken along line 10B-10B in FIG. 2.

As shown in FIG. 10A, as the toner cartridge 15 is mounted to the developing device main body 20, the first engaging portion 78 of the first shutter 75 engages the second engaging portion 50*a* of the second shutter 50, so that the first shutter 75 and the second shutter 50 become movable (rotatable) in conjunction with each other.

As shown in FIG. 10B, before the first shutter 75 rotates, the first opening 77 of the first shutter 75 and the second opening 50*b* of the second shutter 50 are displaced with respect to each other in the direction shown by the arrow S1. Therefore, the supplying opening 72 is closed, and the toner is not ejected from the toner cartridge 15. Further, the second opening 50*b* of the second shutter 50 and the receiving opening 53 of the developing device main body 20 are displaced with respect to each other in the direction shown by the arrow S1, and therefore the receiving opening 53 is closed, with the result that the toner is not supplied to the developing device main body 20. A state where the supplying opening 72 and the receiving opening 53 are both closed (FIG. 10B) is referred to as a closing state.

When the first shutter 75 is rotated in the direction shown by the arrow S1, the first shutter 75 and the second shutter 50 rotate in conjunction with each other (due to the engagement between the first engaging portion 78 and the second engaging portion 50*a*) to reach a position shown by FIG. 11A. The first shutter 75 abuts against the rotation stopper 701 (FIGS. 8A and 8B), and is prevented from further rotating in the direction shown by the arrow S1. In this state, as shown in FIG. 11B, the first opening 77 of the first shutter 75, the supplying opening 72 of the cover cartridge 70, the second opening 50*b* of the second shutter 50 and the receiving opening 53 of the developing device main body 20 are aligned with each other in a vertical direction.

Since the first opening 77 of the first shutter 75 faces the supplying opening 72 of the cover cartridge 70, the supplying opening 72 is opened, and the toner is supplied from the toner cartridge 15 via the supplying opening 72. Further, since the second opening 50*b* of the second shutter 50 faces the receiving opening 53 of the developing device main body 20, the receiving opening 53 is opened, and the toner (supplied from the toner cartridge 15) is supplied into the developing device main body 20 via the receiving opening 53. A state where the supplying opening 72 and the receiving opening 53 are both opened (FIG. 11B) is referred to as an opening state.

In this regard, a size of the first opening 77 is slightly larger than other openings (i.e., the supplying opening 72, the second opening 50*b* and the receiving opening 53). This to prevent a decrease in a substantial opening area of the supplying opening 72 even if the first opening 77 and the supplying opening 72 are slightly misaligned with each other due to distortion caused the by the rotation of the first shutter 75.

Further, in the opening state (FIG. 11B), end positions (i.e., leading end positions) of the first opening 77, the supplying opening 72, the second opening 50*b* and the receiving opening 53 in the direction shown by the arrow S1 are substantially aligned with each other. Therefore, the timing at which the first shutter 75 starts opening the supplying opening 72 is substantially the same as the timing at which the second shutter 50 starts opening the receiving opening 53.

When detaching the toner cartridge 15, the user rotates the lever portion 80 in the direction shown by the arrow S2 as shown in FIGS. 11A and 11B. With the rotation of the lever portion 80 in the direction shown by the arrow S2, the first opening 77 of the first shutter 75 and the supplying opening 72 of the cover cartridge 70 are displaced with respect to each other in the rotational direction as shown in FIG. 10B. That is, the supplying opening 72 is closed. At the same time, the second opening 50*b* of the second shutter 50 and the receiving opening 53 of the developing device main body 20 are displaced with respect to each other in the rotational direction. That is, the receiving opening 53 is closed. Accordingly, the supplying opening 72 and the receiving opening 53 are both closed (i.e., the closing state). In this state, the first shutter 75 abuts against the rotation stopper 702 (FIGS. 8A and 8B), and is prevented from further rotating in the direction shown by the arrow S2.

As described above, according to the first embodiment of the present invention, the toner cartridge 15 has the first shutter 75 for opening and closing the supplying opening 72, and the developing device main body 20 has the second shutter 50 for opening and closing the receiving opening 53. Therefore, in a state where the toner cartridge 15 is not mounted to the developing device main body 20, the receiving opening 53 of the developing device main body 20 is closed by the second shutter 50. Accordingly, it becomes possible to prevent foreign matters from entering the receiving opening 53 during replacement of the toner cartridge 15.

Further, when the toner cartridge 15 is mounted to the developing device main body 20, the first engaging portion 78 and the second engaging portion 50*a* engage each other, and cause the first shutter 75 and the second shutter 50 to move (rotate) in conjunction with each other. Therefore, the first shutter 75 and the second shutter 50 can be operated only by operating the lever portion 80. Thus, it is unnecessary for the user to perform a complex operation.

Furthermore, the rotation of the first shutter 75 is locked in a state where the toner cartridge 15 is not mounted to the developing device main body 20. The lock on the first shutter 75 is released by mounting the toner cartridge 15 to the developing device main body 20. Therefore, it becomes possible to prevent the second shutter 50 from being mistakenly opened in a state where the toner cartridge 15 is not mounted to the developing device main body 20.

Moreover, the first engaging portion 78 of the first shutter 75 has a function to release the lock on the second shutter 50 and another function to establish conjunction between the first shutter 75 and the second shutter 50. Therefore, it becomes possible to simplify a shape and structure for releasing the lock on the first shutter 75 and for establishing the conjunction between the first and second shutters 75 and 50. Further, if a releasing member for releasing the lock on the second shutter 50 is provided on the developing device main body 20, the second shutter 50 is required to have a cutout or the like in order to avoid interference with the releasing member, and the shape of the second shutter 50 may become complicated. However, according to the first embodiment, since the first engaging portion 78 of the first shutter has a function to release the lock on the second shutter 50, and therefore the shape of the second shutter 50 can be simplified.

Modification.

In the above described first embodiment, the timing at which the first shutter 75 opens the supplying opening 72 is substantially the same as the timing at which the second shutter 50 opens the receiving opening 53. However, the present invention is not limited to such an example. For example, it is also possible that the timing at which the first shutter 75 opens the supplying opening 72 is earlier than the timing at which the second shutter 50 opens the receiving opening 53.

Figure 12A:
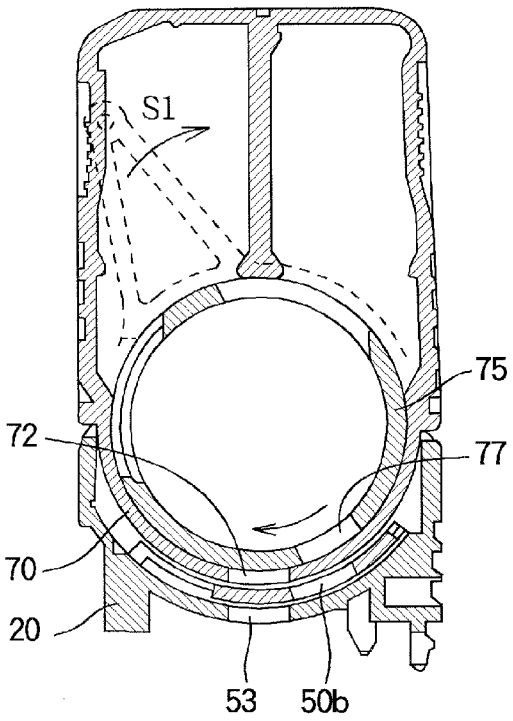
FIGS. 12A and 12B are sectional views showing functions of the first shutter and the second shutter according to a modification of the first embodiment of the present invention.
Figure 12B:
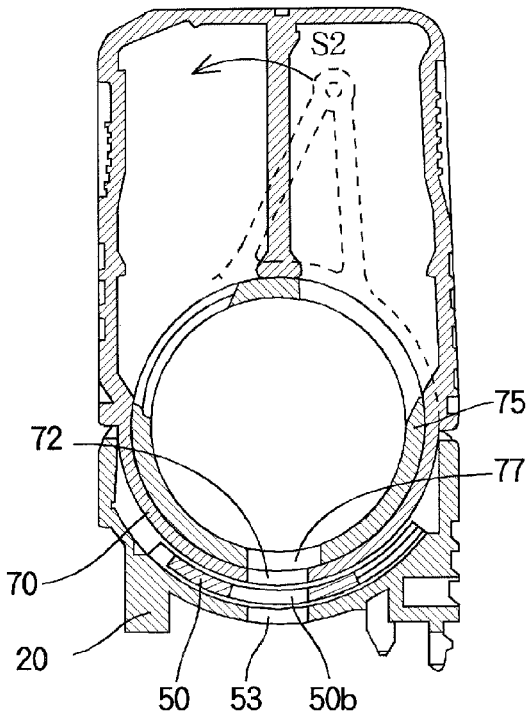

FIGS. 12A and 12B show modification of the first embodiment. FIG. 12A is a sectional view showing the toner cartridge 15 and the developing device main body 20 before the first shutter 75 is rotated. FIG. 12B is a sectional view showing the toner cartridge 15 and the developing device main body 20 after the first shutter 75 is rotated. FIGS. 12A and 12B correspond to the cross section taken along line 10B-10B in FIG. 2. In the closing state shown in FIG. 12B, the leading end position of the second opening 50*b* in the direction of the arrow S1 is located ahead of the leading end of the first opening 77 in the direction of the arrow S1.

With such a configuration, the timing at which the first shutter 75 opens the supplying opening 72 is earlier than the timing at which the second shutter 50 opens the receiving opening 53. Therefore, when the toner starts being supplied via the supplying opening 72 of the toner cartridge 15, the receiving opening 53 of the developing device main body 20 has already been opened. Thus, it becomes possible to prevent the toner (ejected by the supply opening 72 of the toner cartridge 15) from failing to enter the receiving opening 53 to spill out.

When the first shutter 75 is rotated in the direction shown by the arrow S2, the timing at which the first shutter 75 completely closes the supplying opening 72 is earlier than the timing at which the second shutter 50 completely closes the receiving opening 53. Therefore, it becomes possible to prevent the toner from remaining at a portion between the toner cartridge 15 and the developing device main body 20.

As described above, according to the modification of the first embodiment, it becomes possible to prevent the toner from remaining at a portion between the toner cartridge 15 and the developing device main body 20, and to prevent the toner from spilling out.

Second Embodiment

Next, the second embodiment of the present invention will be described.

The second embodiment is different from the first embodiment in a configuration of a process cartridge (100). A description will be made of a difference between the first embodiment and the second embodiment with reference to FIGS. 13, 14 and 15.

Figure 13:
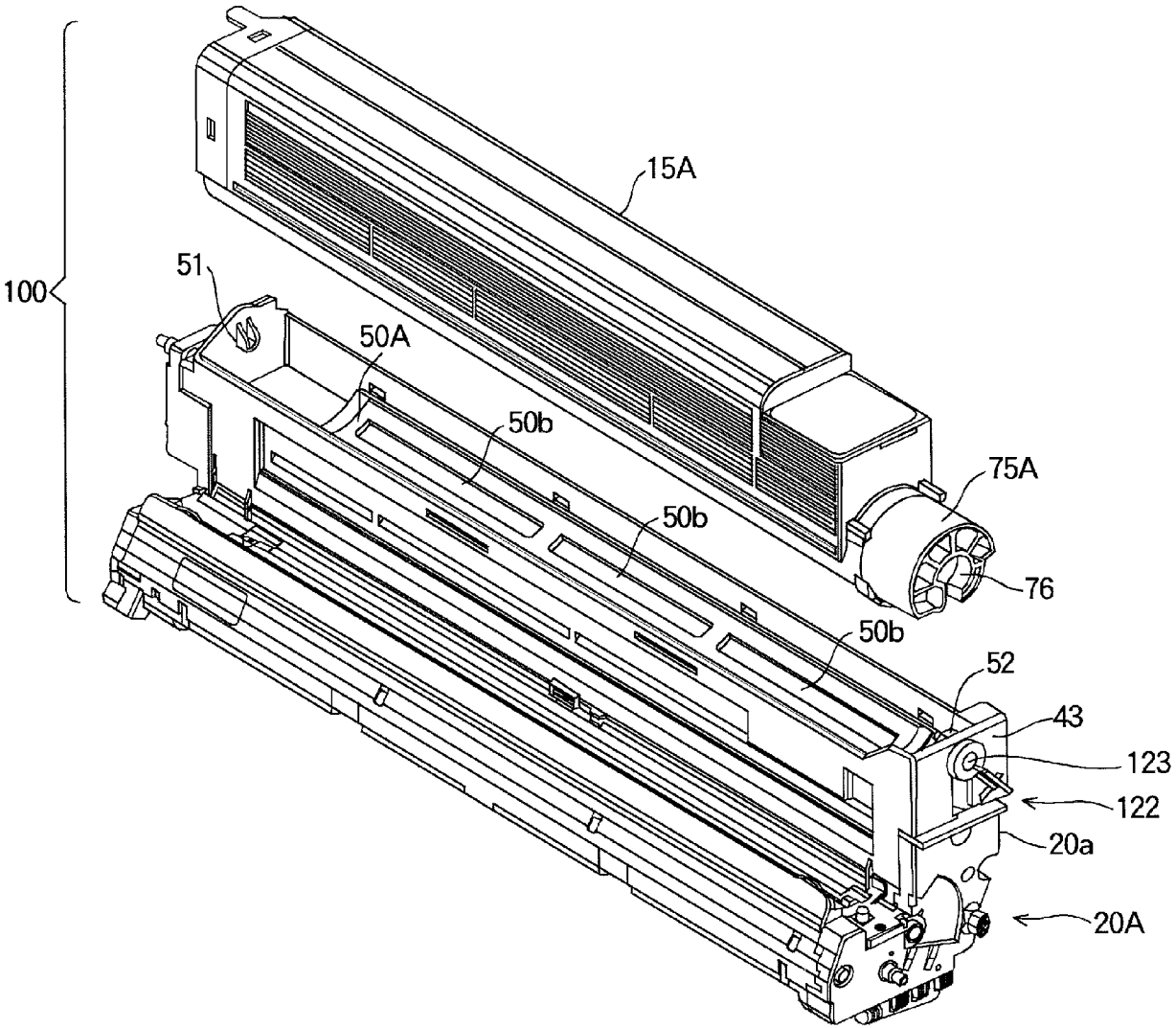
FIG. 13 is a perspective view showing a process cartridge according to the second embodiment of the present invention in a state where a toner cartridge is detached from a unit main body.

FIG. 13 is a perspective view showing a process cartridge 100 according to the second embodiment. The process cartridge 100 has a toner cartridge 15A and a developing device main body 20A instead of the toner cartridge 15 and the developing device main body 20 of the first embodiment.

The toner cartridge 15A of the second embodiment has a first shutter 75A which is different from the first shutter 75 of the first embodiment in that the first shutter 75A has no lever portion 80 (FIG. 2). The toner cartridge 15A is the same as the toner cartridge 15 of the first embodiment in other respects.

The developing device main body 20A of the second embodiment has a second shutter 50A which is different from the second shutter 50 of the first embodiment in that a shutter lever 122 is mounted to an end (on the second convex portion 52 side) of the second shutter 50A in the longitudinal direction. The developing device main body 20A is the same as the developing device main body 20 of the first embodiment in other respects.

Figure 14:
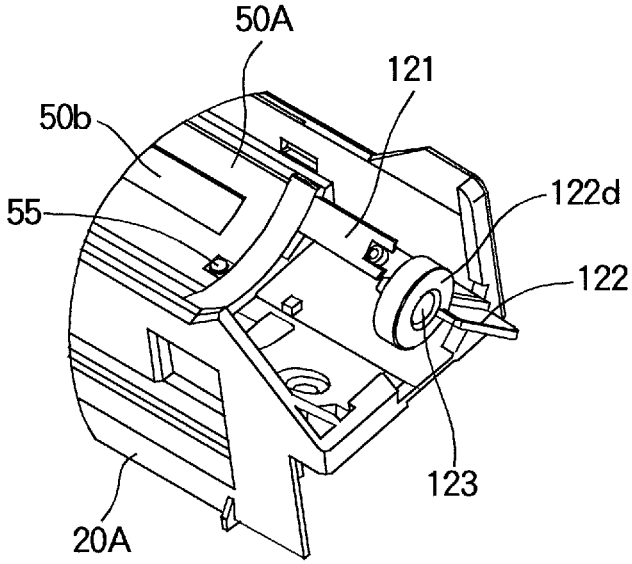
FIG. 14 is an enlarged perspective view showing a part of a unit main body according to the second embodiment of the present invention.
Figure 15:
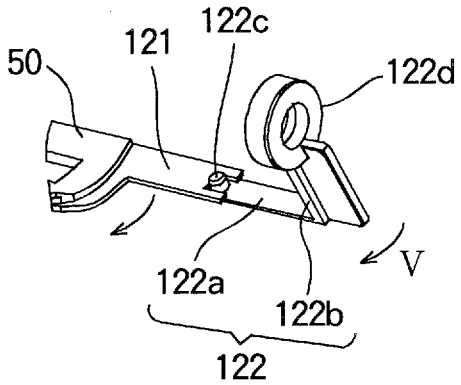
FIG. 15 is a perspective view showing a shutter lever according to the second embodiment of the present invention.

FIG. 14 is an enlarged perspective view showing an end (on the second convex portion 52 side) of the developing device main body 20A in the longitudinal direction. As shown in FIG. 14, the second shutter 50A of the developing device main body 20A has an extension portion 121 (i.e., a third engaging portion) extended in the longitudinal direction of the second shutter 50A. FIG. 15 is an enlarged view of the extension portion 121 and the shutter lever 122. As shown in FIG. 15, an end of the extension portion 121 has a rectangular U-shape. The shutter lever 122 is fixed to the end of the extension portion 121. The shutter lever 122 has an L-shape, and includes a first portion 122*a* extending in the longitudinal direction of the extension portion 121 and a second portion 122*b* extending perpendicularly to the first portion 122*a*.

An engaging portion 122*c* (i.e., a fourth engaging portion) is provided on the first portion 122*a* of the shutter lever 122. The engaging portion 122*c* engages the extension portion 121 of the first shutter 50A. A ring-shaped portion 122*d* is formed at a tip of the second portion 122*b*. A pin 123 (i.e., a rotation shaft) penetrates a center part of the ring-shaped portion 122*d*, and is fixed to a side wall 43 (FIG. 13) of the casing 20*a*. The pin 123 is disposed at a position aligned with the rotation axis of the first shutter 75A. That is, the shutter lever 122 is supported by the pin 123 so that the shutter lever 122 is rotatable about the pin 123.

The mounting operation of the toner cartridge 15A to the developing device main body 20A (i.e., before the first shutter 75A is rotated) is the same as that described in the first embodiment.

In the above described first embodiment, the opening and closing operations of the first shutter 75 and the second shutter 50 are performed by rotating the lever portion 80 of the first shutter 75. In contrast, in the second embodiment, the opening and closing operations of the first shutter 75A and the second shutter 50A are performed by rotating the shutter lever 122 provided on the developing device main body 20A.

That is, when the user rotates the shutter lever 122 about the pin 123 in the direction shown by the arrow V in FIG. 15, the second shutter 50 (connected with the shutter lever 122 via the extension portion 121) slides along the above described sliding surface 42 (FIG. 10A) of the developing device main body 20A.

The first shutter 75A and the second shutter 50A rotate in conjunction with each other by the engagement between the first engaging portion 78 and the second engaging portion 50*a* as in the first embodiment. Therefore, the first shutter 75A and the second shutter 50A are both rotated by the operation of the shutter lever 122.

With such an operation, the first opening 77 (FIG. 11B) of the first shutter 75A faces the supplying opening 72 of the cover cartridge 70, and the supplying opening 72 is opened. Further, the second opening 50*b* of the second shutter 50A faces the receiving opening 53 of the developing device main body 20A, and the receiving opening 53 is opened. Accordingly, the toner is supplied from the toner cartridge 15A to the developing device main body 20A.

As described above, according to the second embodiment, the shutter lever 122 for rotating the first shutter 75A and the second shutter 50A in conjunction with each other is provided on the developing device main body 20A. Therefore, the toner is supplied from the toner cartridge 15A to the developing device main body 20A by operating the shutter lever 122 on the developing device main body 20A side. Therefore, it is unnecessary to provide a lever portion (for rotating operation) on the first shutter 75A. Thus, when the user handles the toner cartridge 15 (detached from the developing device main body 20) alone, it becomes possible to prevent the user from mistakenly operating the lever portion. That is, the toner is not mistakenly ejected from the toner cartridge 15.

The above described modification (FIG. 12) of the first embodiment can also be applied to the second embodiment.

The present invention is not limited to the above described embodiments. For example, the image forming apparatus is not limited to the tandem-type image forming apparatus including the process cartridges of respective colors which are arranged in line. The image forming apparatus can be, for example, a monochrome image forming apparatus, or an intermediate transfer time image forming apparatus using an intermediate transfer belt.

Further, the first shutter 75 is not necessarily rotatable. It is only necessary that the first shutter 75 moves to open and close the supply opening 72. Further, it is only necessary that the second shutter 50 opens and closes the receiving opening 53 in conjunction with the first shutter 75.

The present invention is applicable to, for example, an image forming apparatus such as a copier, printer, facsimile machine having a detachable process cartridge.

While the preferred embodiments of the present invention have been illustrated in detail, it should be apparent that modifications and improvements may be made to the invention without departing from the spirit and scope of the invention as described in the following claims.

What is claimed is:

1. A developing device comprising:

a developing device main body, and a developer cartridge detachably mounted to said developing device main body and storing a developer, said developer cartridge comprising:

a case member that stores said developer;

a supplying opening provided on said case member, and a first shutter that opens and closes said supplying opening, said first shutter having a first engaging portion, said developing device main body comprising:

a housing that stores said developer supplied by said developer cartridge;

a receiving opening provided on said housing, and a second shutter that opens and closes said receiving opening, said second shutter having a second engaging portion, wherein, when said developer cartridge is mounted to said developing device main body, said first engaging portion engages said second engaging portion, wherein said housing of said developing device main body has a lock member that locks a movement of said second shutter, wherein, when said developer cartridge is mounted to said developing device main body, said first engaging portion engages said second engaging portion and also presses said lock member so that said lock member allows said second shutter to move, wherein said first shutter and said second shutter are configured to move in conjunction with each other by engagement between said first engaging portion and said second engaging portion.

2. The developing device according to claim 1, wherein said first shutter or said second shutter has an operating portion which is operated by a user to move said first shutter and said second shutter to open and close said supplying opening and said receiving opening.

3. The developing device according to claim 1, wherein said first shutter is rotatably provided in said case member to open and close said supplying opening.

4. The developing device according to claim 1, wherein said second shutter is provided on said developing device main body so as to be slidable along an outer circumferential surface of said developer cartridge.

5. The developing device according to claim 1, wherein said lock member consists of a second lock member and said first shutter has a first lock member that engages said case member so as to lock a movement of said first shutter, wherein, when said developer cartridge is mounted to said developing device main body, said first lock member is pressed by a part of said housing and allows said first shutter to move.

6. The developing device according to claim 5, wherein said first lock member has a deformable part, and engages an engaging opening provided on said case member, wherein, when said developer cartridge is mounted to said developing device main body, said first lock member is deformed by being pressed by said part of said housing, and is disengaged from said engaging opening, said part of said housing comprised of a protrusion, said second lock member comprised of a shutter lock.

7. The developing device according to claim 1, wherein said second engaging portion is an engaging hole which said lock member engages, and wherein, when said developer cartridge is mounted to said developing device main body, said first engaging portion engages said engaging hole and presses said lock member to move out of said engaging hole.

8. The developing device according to claim 1, wherein said second shutter opens said receiving opening before said first shutter opens said supplying opening, and closes said receiving opening after said first shutter closes said supplying opening.

9. The developing device according to claim 1, wherein said first shutter and said second shutter respectively have a first opening and a second opening; wherein said first shutter and said second shutter move in a same moving direction to cause said first opening and said second opening to respectively face said supplying opening and said receiving opening so as to open said supplying opening and said receiving opening, and wherein, in a state where said supplying opening and said receiving opening are opened, an end of said second opening in said moving direction is located ahead of an end of said first opening in said moving direction.

10. An image forming unit comprising:

said developing device according to claim 1.

11. An image forming apparatus comprising:

said image forming unit according to claim 10.

12. The image forming apparatus according to claim 11, wherein said image forming unit is a process cartridge detachably mounted to a main body of said image forming apparatus.

13. A developing device comprising:

a developing device main body, and a developer cartridge detachably mounted to said developing device main body and storing a developer, said developer cartridge comprising:

a case member that stores said developer;

a supplying opening provided on said case member, and a first shutter rotatably provided in said case member to open and close said supplying opening, said first shutter has a first lock member that engages said case member so as to lock a movement of said first shutter, said developing device main body comprising:

a housing that stores said developer supplied by said developer cartridge;

a receiving opening provided on said housing, and a second shutter provided on said developing device main body so as to be slidable along an outer circumferential surface of said developer cartridge to open and close said receiving opening, wherein said first shutter and said second shutter are configured to move in conjunction with each other, wherein said first shutter or said second shutter has an operating portion which is operated by a user to move said first shutter and said second shutter to open and close said supplying opening and said receiving opening, wherein said housing of said developing device main body has a second lock member that locks a movement of said second shutter, and wherein, when said developer cartridge is mounted to said developing device main body, said first lock member is pressed by a part of said housing and allows said first shutter to move, and said first engaging portion engages said second engaging portion and also presses said second lock member so that said second lock member allows said second shutter to move.

* * * * *